US006022173A

United States Patent [19]

Saxon

[11] Patent Number: 6,022,173

[45] **Date of Patent: *Feb. 8, 2000**

[54] UNDERWATER TRENCHING SYSTEM

[76] Inventor: Saint E. Saxon, 900 Oakwood Dr., Gretna, La. 70056

[ * ] Notice: This patent is subject to a terminal disclaimer.

[21] Appl. No.: 08/876,814

[22] Filed: Jun. 16, 1997

Related U.S. Application Data

[63] Continuation-in-part of application No. 08/539,233, Oct. 4, 1995, Pat. No. 5,639,185, which is a continuation-in-part of application No. 08/182,971, Jan. 13, 1994, Pat. No. 5,456,551.

[51] Int. Cl.[7] ..... E02F 3/04

[52] U.S. Cl. ..... 405/163; 37/337; 405/158; 405/161; 405/162

[58] Field of Search ..... 405/159–164, 405/158; 37/337–342, 347, 352

[56] References Cited

U.S. PATENT DOCUMENTS

| | | | |
|---|---|---|---|
| 3,995,439 | 12/1976 | Hahlbrock | 405/161 |
| 4,117,689 | 10/1978 | Martin | 405/163 |
| 4,193,713 | 3/1980 | Van Nes | 405/159 |
| 4,274,760 | 6/1981 | Norman | 405/163 |
| 4,295,757 | 10/1981 | Gasper | 405/163 |
| 4,516,880 | 5/1985 | Martin | 405/163 X |
| 4,586,850 | 5/1986 | Norman et al. | 405/163 |

FOREIGN PATENT DOCUMENTS

| | | | |
|---|---|---|---|
| 2905540 | 8/1979 | Germany | 405/163 |

*Primary Examiner*—Dennis L. Taylor
*Attorney, Agent, or Firm*—Joseph T. Regard, Ltd.

[57] ABSTRACT

A self-guided system for trenching water bottoms for the installation of a pipeline. The preferred embodiment of the present invention teaches a system which is configured to be mounted about the pipeline to be buried, and which further contemplates a uniquely configured, forward mounted trenching/drive mechanism incorporating a cutter wheel generally about the width of the desired trench, the mechanism configured to propel the system as well as trench the desired area. An alternative embodiment of the contemplates a frontal high pressure jet array in lieu of the cutter head. The trenching/drive mechanism of the preferred embodiment of the present invention further includes a high pressure spray array mounted about the frontal cutter wheel area, and a suction/mud pump assembly to the rear of the cutter wheel. The high pressure spray array provides the dual purpose function of loosening the area to be trenched, as well as cleaning and removing the trenched matter from the cutter wheel. The present invention further includes first and second buoyancy chambers which are configured to be uniformly lowered to the lower periphery of the unit frame, to provide skids for utilization of the present system in shallow water. An alternative embodiment of the present invention teaches the incorporation of a framed system similar to that as taught in the present invention, but without the trenching/drive mechanism, and with the addition of a pipe cutter mounted to the rear of the unit frame, for utilization of pipeline recovery and dismemberment operations. Other features of the present invention which are taught, and which may be implemented, include G.P.S. (global positioning system) receiver/data transmission for precise monitoring of the system during operations, thruster propulsion, and bottom loading of pipe into the frame via hinged bottom rollers, which may be powered.

5 Claims, 15 Drawing Sheets

T
210
211
204
206
11B
203
32
49'
208
51
45
47
42
49
7
25
43
205
9
41'
207
48'
46
44
210
209
50
11A
31
202
201
P

T
220
219
118
32
45
51
47
49
42
7
43
25
9
41'
48'
46
44
50
11A
31
P
216
214
218
213
217
215

UNDERWATER TRENCHING SYSTEM

STATEMENT OF CONTINUING APPLICATIONS

This application is a continuation-in-part of application Ser. No. 08/539,233, filed Oct. 4, 1995, now U.S. Pat. No. 5,639,185, which is a continuation-in-part of application Ser. No. 08/182,971, filed Jan. 13, 1994, now U.S. Pat. No. 5,456,551.

BACKGROUND OF THE INVENTION

1. Invention Field

The present invention relates to underwater trenching systems, and more particularly to a self-guiding system for trenching water bottoms for the installation of a pipeline. The preferred embodiment of the present invention teaches a system which is configured to be mounted about the pipeline to be buried, and which further contemplates a uniquely configured, forward mounted trenching/drive mechanism incorporating a cutter wheel generally about the width of the desired trench, the mechanism configured to propel the system as well as trench the desired area. An alternative embodiment of the contemplates a frontal high pressure jet array in lieu of the cutter head.

The trenching/drive mechanism of the preferred embodiment of the present invention further includes a high pressure spray array mounted about the frontal cutter wheel area, and a suction/mud pump assembly to the rear of the cutter wheel. The high pressure spray array provides the dual purpose function of loosening the area to be, trenched, as well as cleaning and removing the trenched matter from the cutter wheel.

The present invention further includes first and second buoyancy chambers which are configured to be uniformly lowered to the lower periphery of the unit frame, to provide skids for utilization of the present system in shallow water.

Other features of the present invention which are taught, and which may be implimented, include G.P.S. (global positioning system) receiver/data transmission for precise monitoring of the system during operations, thruster propulsion, and bottom loading of pipe into the frame via hinged bottom rollers, which may be powered.

Another alternative embodiment of the present invention teaches the incorporation of a framed system similar to that as taught in the present invention, but without the trenching/drive mechanism, and with the addition of a pipe cutter mounted to the rear of the unit frame, for utilization of pipeline recovery and dismemberment operations.

GENERAL BACKGROUND DISCUSSION

While the prior art may have contemplated a variety of underwater trenching systems for utilization in conjunction with laying pipe and related operations, none are believed to have contemplated the combination trencher/drive system of the cutter mechanism contemplated by the present invention.

A list of prior patents which may be of interest is presented below:

| Patent No. | Patentee(s) | Issue Date |
|---|---|---|
| (Plough Trenchers): | | |
| 4992000 | Doleshal | 02/12/91 |
| 4980097 | Lynch | 01/22/91 |
| 4410297 | Lynch | 10/18/83 |

-continued

| Patent No. | Patentee(s) | Issue Date |
|---|---|---|
| 4245927 | Wharton | 01/20/81 |
| 4091629 | Gunn et al | 05/30/78 |
| (Cutter Wheel Trenchers/Dredges): | | |
| 4416014 | Satterwhite | 09/26/78 |
| 4301606 | Hofmeester | 11/24/81 |
| 4329087 | Satterwhite | 05/11/82 |
| 4314414 | Reynolds et al | 02/09/82 |
| 4470720 | Lennard | 09/11/84 |
| 4149326 | Rosa et aI | 04/17/79 |
| 3023586 | Morrison | 03/06/62 |
| 0708583 | Powell | 09/09/02 |
| 0941050 | Sykes | 11/23/09 |
| 3605296 | Dysart | 09/20/71 |
| 1220197 | Cowles | 03/27/17 |
| 0814270 | Burch | 03/06/06 |
| 0737021 | Roberts | 08/25/03 |
| 0141752 | Boschke | 08/12/73 |
| 0171380 | Hawley | 12/21/1875 |
| 0158717 | Kuhn | 01/12/1875 |
| (Trenchers with Lateral Cutting Members): | | |
| 4280289 | Bassompierre-Sewrin | 06/28/81 |
| 4274760 | Norman | 06/23/81 |
| 4022028 | Martin | 05/10/77 |
| 4714378 | Lincoln | 12/22/87 |
| 4516880 | Martin | 05/14/85 |
| 4117689 | Martin | 01/03/78 |
| 4087981 | Norman | 05/09/78 |
| 4044566 | Biberg | 08/30/77 |
| 3995439 | Hahlbrock | 12/07/76 |
| 3887237 | Norman | 04/15/75 |
| 3670514 | Breston et al | 06/20/72 |
| 3583170 | DeVries | 06/08/71 |
| (Movable Bit Trencher): | | |
| 3978679 | Lecomte | 09/07/76 |
| (Fixed Propeller Trencher): | | |
| 3004392 | Symmank | 10/17/61 |

The prior art contemplates various systems for trenching, including for the installation of pipelines, including the following general categories:

A. Plough Trenchers

B. Cutter Wheel Trenchers/Dredges

C. Trenchers with Lateral Cutter Members

D. Movable Bit Trenchers

E. Fixed Propeller Trenchers

The present, searched for invention, as described above, teaches a system for excavating a trench for the burial of a pipeline incorporating many components as set forth in the patents cited herein.

Referring to category "A", U.S. Pat. No. 4,992,000 teaches a trenching sled which includes forward jets for loosening the area, and a rearwardly directed suction means for removing the trenched material.

Referring to category "B". U.S. Pat. No. 4,301,606 issued 1981 to Netherlands Offshore Co. teaches a underwater trenching apparatus for pipelines utilizing a cutter wheel (15) and water jets (24) for loosening the trenched material and rearly situated suction (22) for removing said trenched material.

U.S. Pat. No. 4,374,760 in Category "C" teaches a "Self Propelled Underwater Trenching Apparatus." to Norman which teaches a drive system which may have some general pertinence to the anode jumper system of the present invention.

U.S. Pat. No. 4,280,289 teaches another trencher which utilizes lateral cutter members, claiming a means of manipulating the rollers to avoid obstacles.

As may be denoted by a review of the above, there have been several machines configured to dig a trench in the bottom of the water to bury pipe, cables, etc. However, unlike the prior art, the present invention has a unique cutter mechanism which provides propulsion or driving means during operation.

SUMMARY DISCUSSION OF THE INVENTION

The present invention overcomes these prior art problems by providing an underwater trenching system for laying pipe and related activities which is highly reliable, relatively economical and overall effective in a variety of environmental and operative conditions.

A believed persistent problem with prior art underwater pipeline trenchers is that the drive mechanism has been ineffective at best or inoperative at worst under many operative conditions, the prior art relying primarily upon powered rollers contacting the pipe to be laid, pulling the unit frame along as the independently operated cutting system removes the water bottom. It is asserted that such a system may be ineffective for propelling the system along under certain conditions, as such a system relies upon the frictional contact of the transport rollers with the pipeline, which may be coated with lubricants or a slippery plastic or other rust inhibiting coating.

Unlike the prior art, the present system teaches a combination cutting mechanism/drive mechanism for propelling the system along as it performs the trenching operation, pulling the unit frame as it trenches, and thereby preventing hang-ups.

The present invention further contemplates the utilization of high pressure suction for removing and dispersing the cut water bottom matter, and directing said pressurized matter from the rear of the unit frame, providing additional forward force to assist in the propulsion of the present system along during the trenching process.

The present invention is configured such that the pipe is positioned in the side of the machine. The bottom rollers are stationary on the machine making a solid foundation for the pipe rollers to fasten to. Only two rollers, one on the front and one on the back of the machine are adjustable. This is compared to the above indicated prior art machines, wherein all four rollers are moveable, and thereby tend to slip on the pipelines, causing damage to the coating.

The present invention, unlike the prior art, utilizes hydraulic powered screw jacks to apply pressure to the upper rollers for gripping the pipeline. The screw jacks may be controlled manually or via trip switches, which can be automatically situated to allow the loosening of the rollers for passage of pipe joints or the like through the rollers.

An alternative embodiment of the present invention, especially configured for utilization on water bottoms including sugar sand, light mud suspensions or the like, is also provided, contemplating a frame having front and rear ends, a top and a bottom, and a pipe passage formed therethrough enveloped by upper and lower rollers. The frontal portion of the frame includes forward emanating high pressure jets of water for trenching the water bottom, while the rear portion may include thrusters; alternatively, driven impellers or propellers may be provided affixed to first and second pontoon members, as will be further discussed. The thrusters, impellers, or propellers may be provided in pairs at opposing sides of the vessel, or in the case of pontoons, one on each pontoon, so as to allow one to maneuver, or steer the vessel, when desired, via selective powering of each of the thrusters, impellers, or propellers.

The alternative embodiment further contemplates a bottom entry system for the pipe, wherein the lower rollers are releasable at one end, and hingedly connected to the frame at the other end, so as to be manually or powered via hydraulic or other motor means from a pipe engaging, horizontal position to an open, generally vertical position, allowing passage of the pipe through the frame and up to or away from the upper rollers, for installation or de-installation of the frame about the pipeline, respectively.

Other options for the present invention include G.P.S. (global positioning satellite) navigational systems provided on the frame of the unit, to relay the position of the unit to the operating barge or other vessel.

In addition to having pipeline and cable installation capability, an alternative design is configured for removal of the pipeline as well.

It is thus an object of the present invention to provide an underwater trenching system which may be utilized in a variety of environmental and operative conditions.

It is another object of the present invention to provide an underwater trenching system which utilizes a cutting/propulsion mechanism for driving the unit frame along the pipeline.

It is still another object of the present invention to provide an underwater trenching system which does not rely upon powered traction rollers engaged to the pipeline for driving the system It is another object of the present invention to provide an underwater trenching system which incorporates a buoyancy/pontoon system which may also be utilized as a sled/skid system in shallow water areas.

It is another object of the present invention to provide an underwater trenching system which includes bottom pipe entry means, propulsion via thrusters, propellers, or impellers or the like, G.P.S. position fixing, and a forward high pressure jet array, thereby providing a system which is suitable for trenching sugar sand, light suspension mud and other "soft" water bottoms.

These and other objects of the present invention will be further discussed in the detailed specification of the invention infra.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE INVENTION

Figure 1:
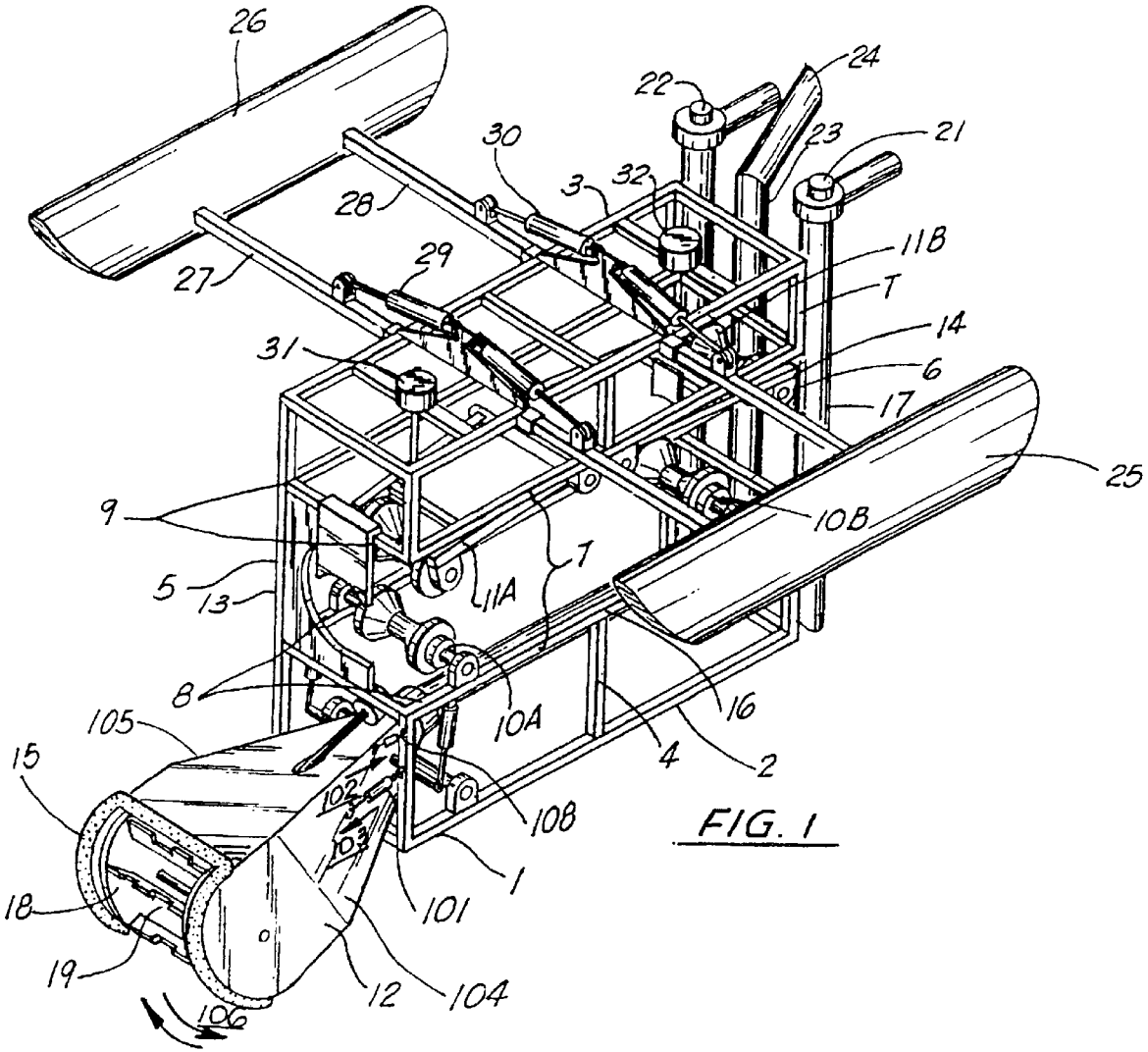
FIG. 1 is an isometric view of the preferred embodiment of the underwater trenching apparatus of the present invention.

As can be seen in FIG. 1, the underwater trenching system of the preferred. exemplary embodiment of the present invention, includes a trenching apparatus T having a unit frame 2 having a lower 1 and upper end 3 with a medial area 6 therebetween, first 4 and second 5 sides, a front 13 and a rear 14.

As further illustrated, formed through the medial area 6 of the frame is a longitudinal opening forming a pipeline passage 7 passing through the front 13 and rear 14 sections of the frame, and surrounded on three sides by lower 8 and upper 9 support frames, communicating via the second side 5 of the frame. As shown, the first side 4 of the frame has a medial opening corresponding with the pipeline conduit 7, as will be more fully explained below.

As shown, affixed to the lower support frame 8 are forward 11A and rear 10B, longitudinally aligned rollers, while pivotally affixed to the upper support frame are forward 11A and rear 11B rollers, said rollers configured to, in conjunction with the lower rollers, envelope, grip and roll said unit frame 2 along a pipeline. Rollers 11A, 11B may further include drive/braking means, and are configured to pivotally adjust via screw jacks 31, 32, their detailed operation of which will be set forth infra.

Pivotally affixed to the lower 1 front 13 section of frame 2 is the cutterldriving mechanism, a "ditch digger", comprising a cutter housing 12 having an open front 18 and having situated about said open front's periphery a high pressure spray array 15 having a plurality of spray orifices emanating therefrom.

Situated within the front opening of said cutter housing is cutter wheel 19, having a width approximately that of the unit frame, and a further comprising a multitude of cutting members in axial alignment with said wheel, said wheel rotating about an axis generally transversal to the longitudinal axis of said unit frame. As will be further disclosed infra, debris trenched by said cutter wheel is directed via suction through said housing 12 and into a high pressure discharge conduit 16, where it is guided along the length of the unit frame, up lateral column 23 and out of the system via conduit 24.

Also removing trenched debris from the area are first 17 and second 20 lateral columns, configured to remove debris from the newly trenched bottom area via mud pumps 21, 22, respectively.

Providing buoyancy to the system are first 25 and second 26 pontoons, each spaced from the unit frame sides via first 27 and second 28 pivot arms, controlled by reciprocating pistons 29, 30, respectively.

As further shown, pistons 101 may be provided having first and second ends, the first end pivotally affixed to the front of the unit frame, the second affixed to the opposing 105, 104 sides of the cutter housing 12, for pivotally maneuvering said cutter housing. For example, retracting 102 piston 101 on side 104 of the cutter housing would urge the front of said housing generally toward 106 said piston 101, while extending 103 said piston would urge the front of said housing generally away from 107 said piston, effectively allowing the user to drive the present invention during the cutting operation. Load sensors 108 on either side of the cutter housing would allow an operator to monitor uneven pressures on the cutter housing, allowing monitoring of the progress of the system even in murky waters.

Figure 2:
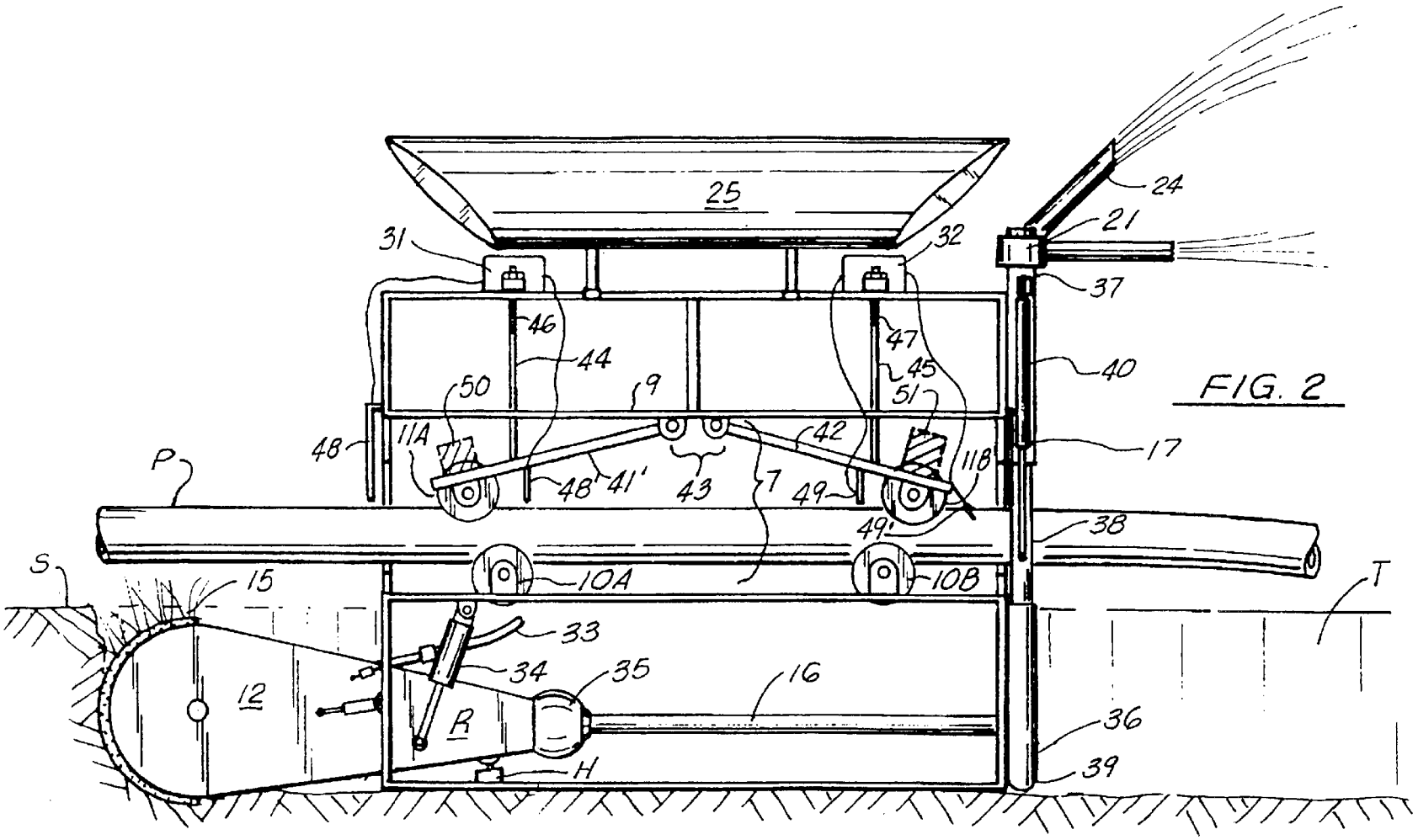
FIG. 2 is a side view of underwater trenching apparatus of FIG. 1, illustrating the operation of the cutter/drive mechanism and jetting/dispersion of trenched material.
Figure 4:
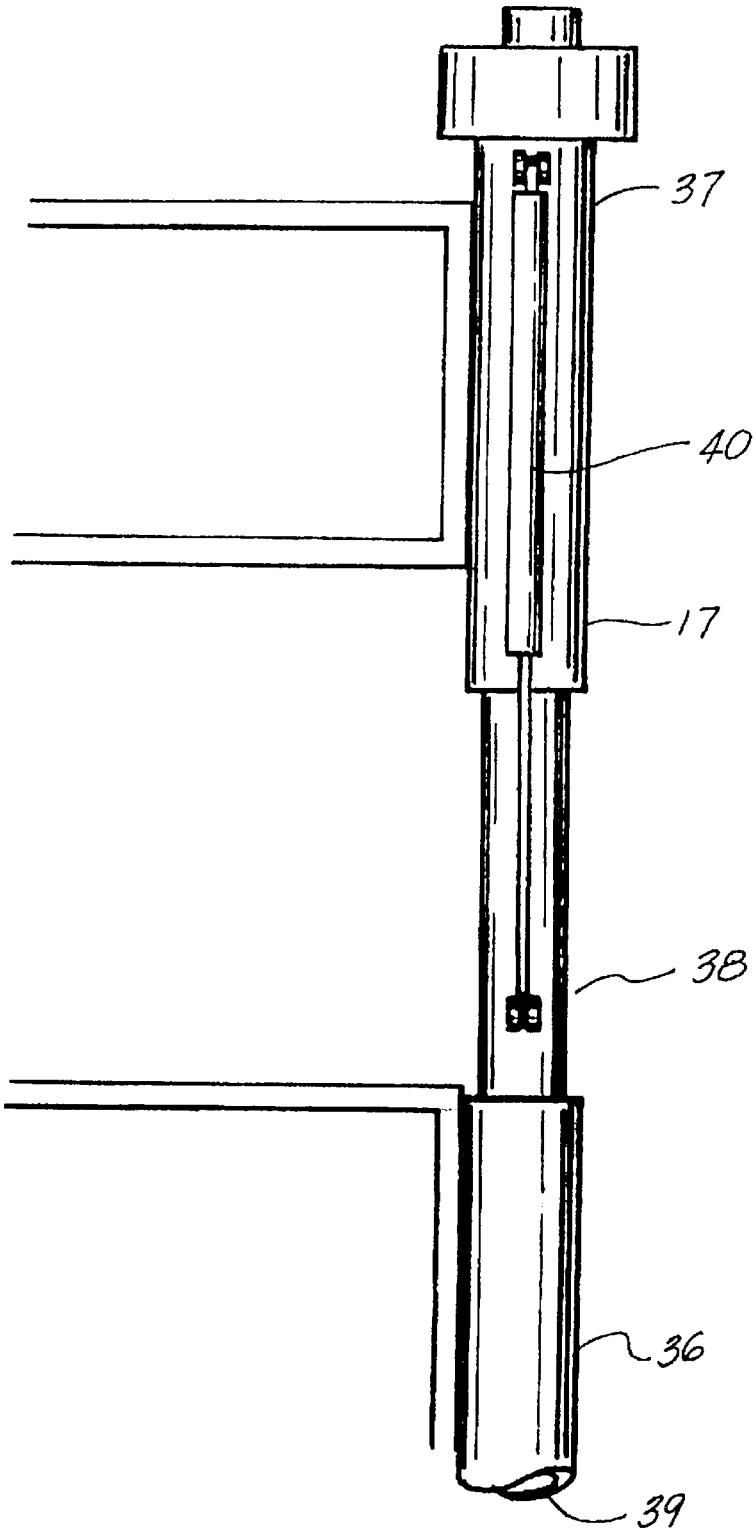
FIG. 4 is a rear, close-up side, closed view of the reciprocating dispersion conduit of the suction array of the trenching apparatus of FIG. 1.

FIG. 2 illustrates a side view of the present invention in operation, cutting a trench T through the seabed S, installing a pipe P. As shown, in operation, the pipeline P is configured to pass through the pipeline passage via the opening (7) formed in the first side wall of the unit frame, as shown in FIG. 1. Referring to FIG. 4, the first 17 lateral column includes a lower end 36 having a lower suction opening 39 and upper end 37 having a mud pump 21 mounted thereon, and a discharge port.

Figure 5:
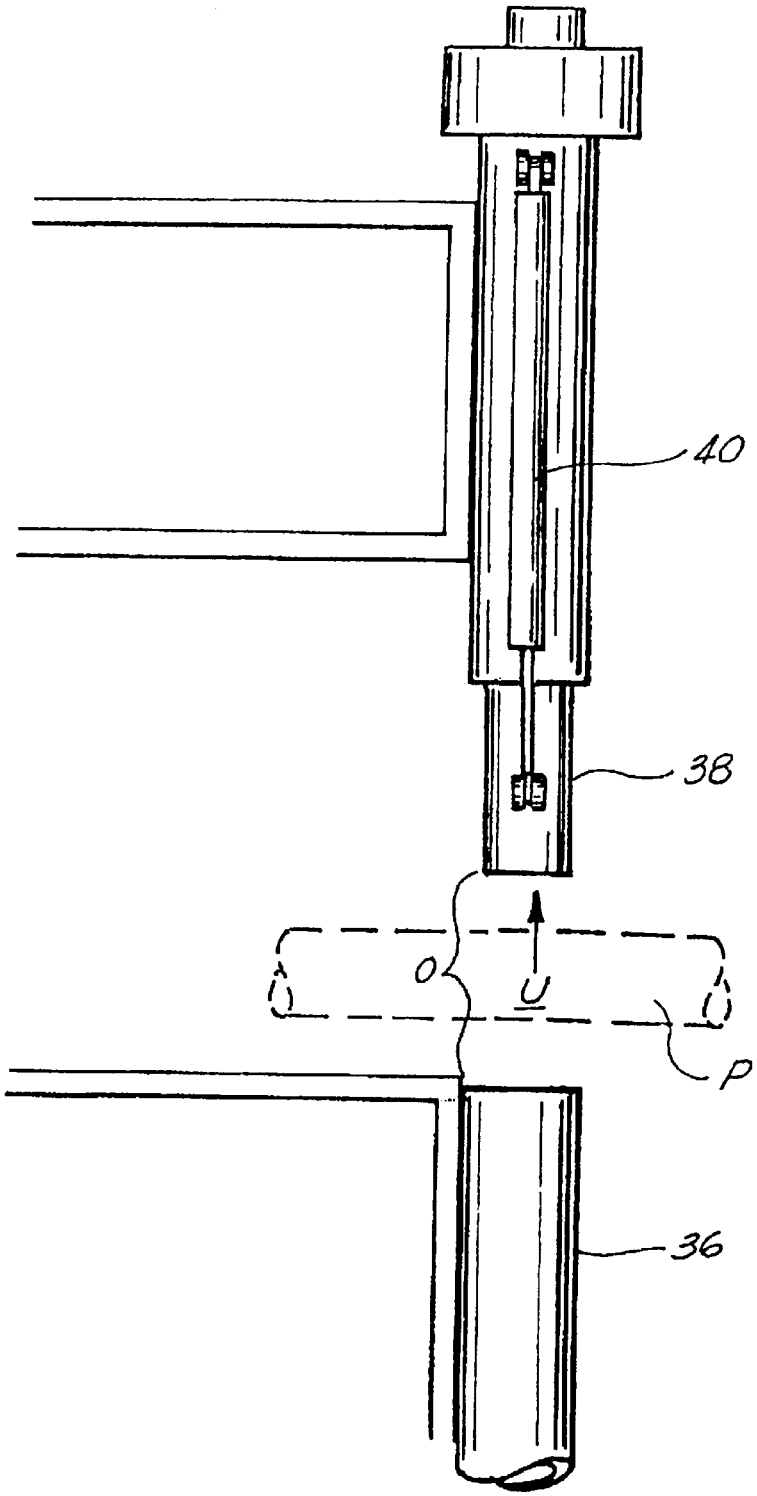
FIG. 5 is a side view of the reciprocating conduit of the suction array of FIG. 4, illustrating the reciprocating conduit in the open position to allow the pipeline to pass therethrough.

Juxtaposed the upper and lower ends of the first lateral column is a medial area comprising a slidingly adjustable column 38 configured to slidingly migrate up U into the upper area of said lateral column via reciprocating piston 40, thereby providing an opening O for placement of the pipe P therethrough, as more fully shown in FIG. 5.

Returning to FIG. 2, once the pipeline is positioned within the conduit, the slidingly adjustable column 38 forming the medial area of the first lateral column 17 is lowered to communicate with the lower section, and the pipe P is positioned upon the fixed, lower rollers 10A, 10B. Lastly, the pivoting upper rollers 11A, 11B are lowered to frictionally engage pipe P via screw jacks 31, 32 engaging pivot support arms 43, 42 via threaded 46, 47 lateral adjustment shafts 44, 45, respectively. As shown, pivot support arms 41, 42 have rollers 11A, 11B connected to opposing first ends, and said second ends are connected to the medial area 43 of upper support frame 9.

Figure 6:
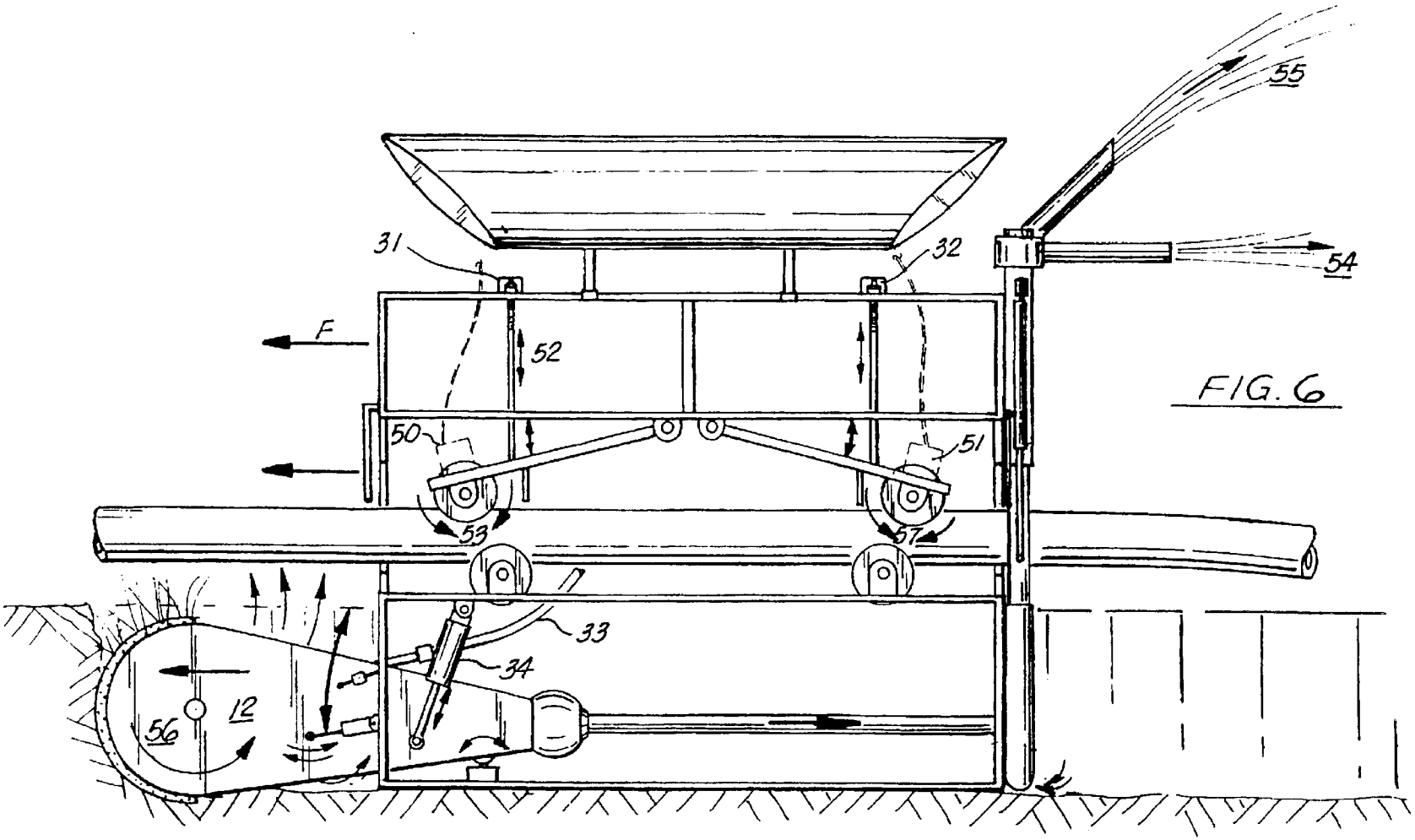
FIG. 6 is a side view of the underwater trenching apparatus of FIG. 1, illustrating the operative driving of the cutteridrive mechanism and jetting dispersion of the present system in operation.
Figure 7:
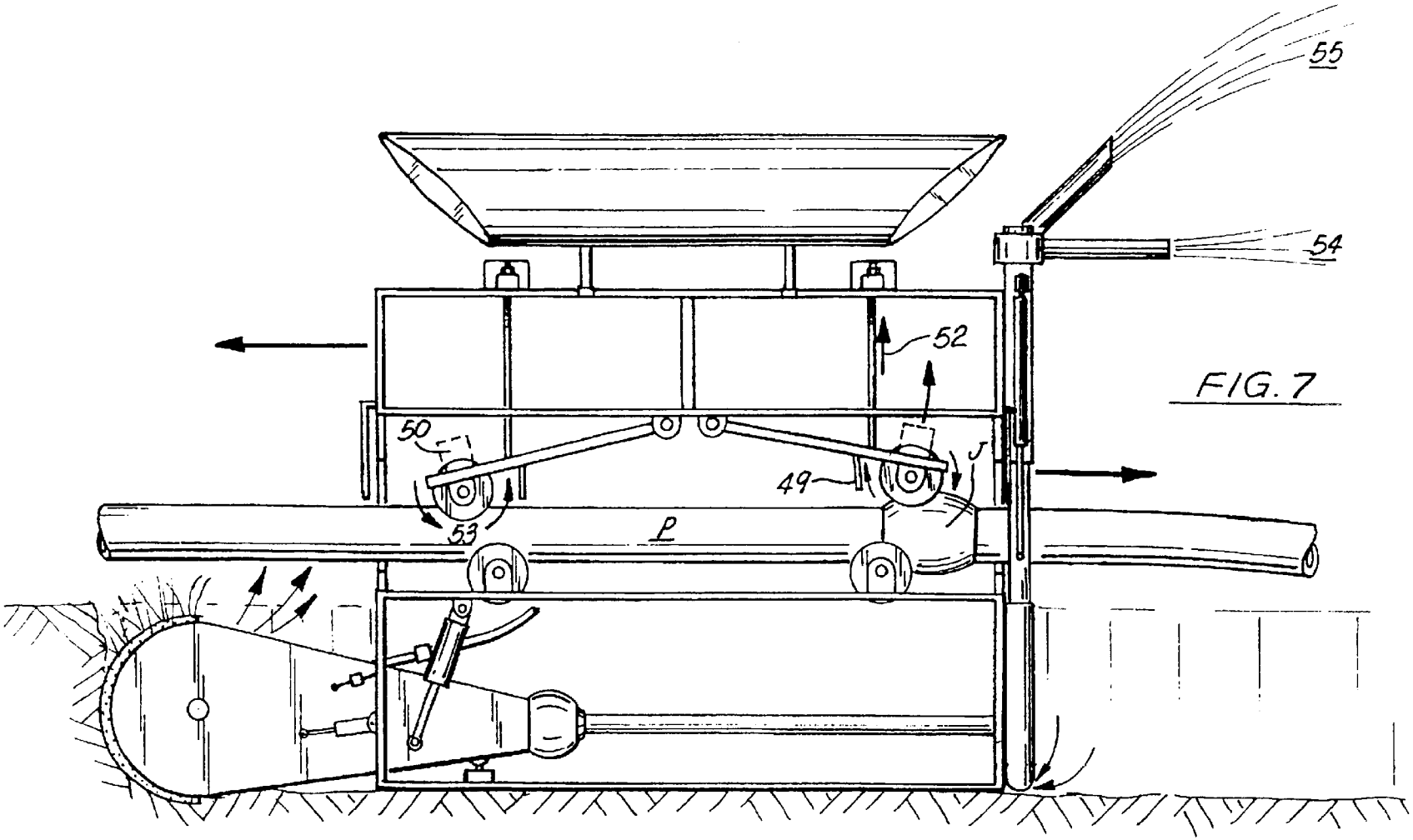
FIG. 7 illustrates the operation of the rachet driven roller carriage to allow the passage of an exemplary pipe joint therethrough.

As shown in FIGS. 2, 6, and 7, pivoting upper rollers 11A, 11B may have mounted thereon front 50 and rear 51 hydraulic motors and/or brakes, for assisting in driving the unit frame along the pipeline, or regulating same when the cutter wheel is in use. The rollers may be selectively raised and lowered 52, to allow the passage of anodes or the like therethrough, via the utilization of proximity switches 48, 49 to raise, and switches 48', 49' to lower the rollers via screw jacks 31, 32 respectively, selectively and automatically allowing the raising and lowering of the rollers 11A, 11B so that obstacles such anodes J, as shown in FIG. 6, may pass therethrough.

An alternative form of the present invention may utilize a single front and single rear proximity switch to raise and lower both the rollers 11A, 11B at the same time via their respective screw jacks 31, 32, to allow the passage of the anode or obstacle. This universal control for simultaneous raising and lowering of the rollers may be desirable where the independent operation of any one of the rollers without the other would mar or otherwise damage the protective coatings on the pipeline.

As shown, the cutter wheel housing tapers from a relatively wide, open area to a relatively narrow, rear area R, wherein said housing is pivotally connected to the lowver front portion of the unit frame via pivot point H which may comprise, for example, a ball hitch/socket arrangement.

Cutter wheel in cutter wheel housing 12 is driven via hydraulic motor which is supplied power via line 33 from the surface barge, and said cutter wheel housing 12 is controlled or steered via hydraulic pistons 34 mounted to each side of said housing, the underside of which is mounted to the lower portion of the unit frame, as shown in FIG. 6.

Figure 8:
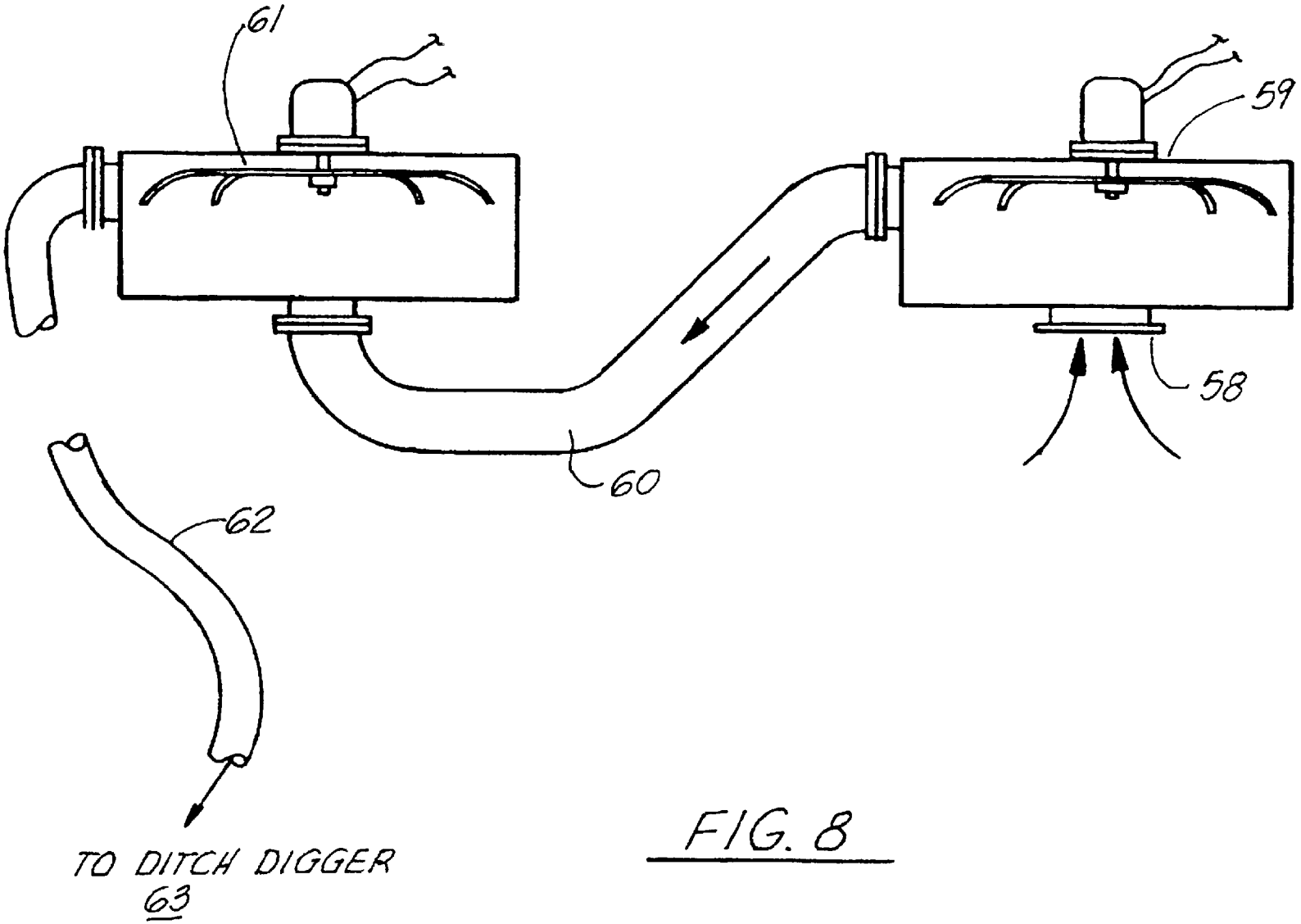
FIG. 8 illustrates the first and second exemplary pumps for providing high pressure spraying action for the spray array situated about the front end of the cutter mechanism.

As shown in FIGS. 2, 6, 11, 12, and 13, the rear of the housing includes mud pump 35 are configured to provide suction to direct the trenched debris from said cutter wheel through the suction/discharge conduit 16, jettisoning via discharge conduit 24 situated at an angle dispersing the pressurized debris in an angled upward path 55 to the upper rear area of the unit frame, providing downward, forward propulsion on said frame, while directing the rear portion of said frame downward to allow the lower, suction openings 39 of the lateral conduits to communicate with the trench T bottom, wherein loose trench bottom is directed up said lateral conduits via mud motors 21, and out of discharge conduits 54, at a directly rearward discharge 54, providing additional forward propulsive force F. The cutter wheel revolves in a forwardly directed revolution 56 relative the unit frame, providing propulsive force forward in addition to cutting the water bottom to form a trench. FIG. 8 illustrates an exemplary series pump configuration for providing stepped, high pressure fluid for powering the spray array 15 formed about the periphery of the cutter wheel opening on the cutter wheel housing. As shown, sea water is taken in via suction opening 58 and pumped via first stage pump 59, through conduit 60 to second stage pump 61, prior to being directed to the array about the ditch digger 63 via hose 62.

Figure 3:
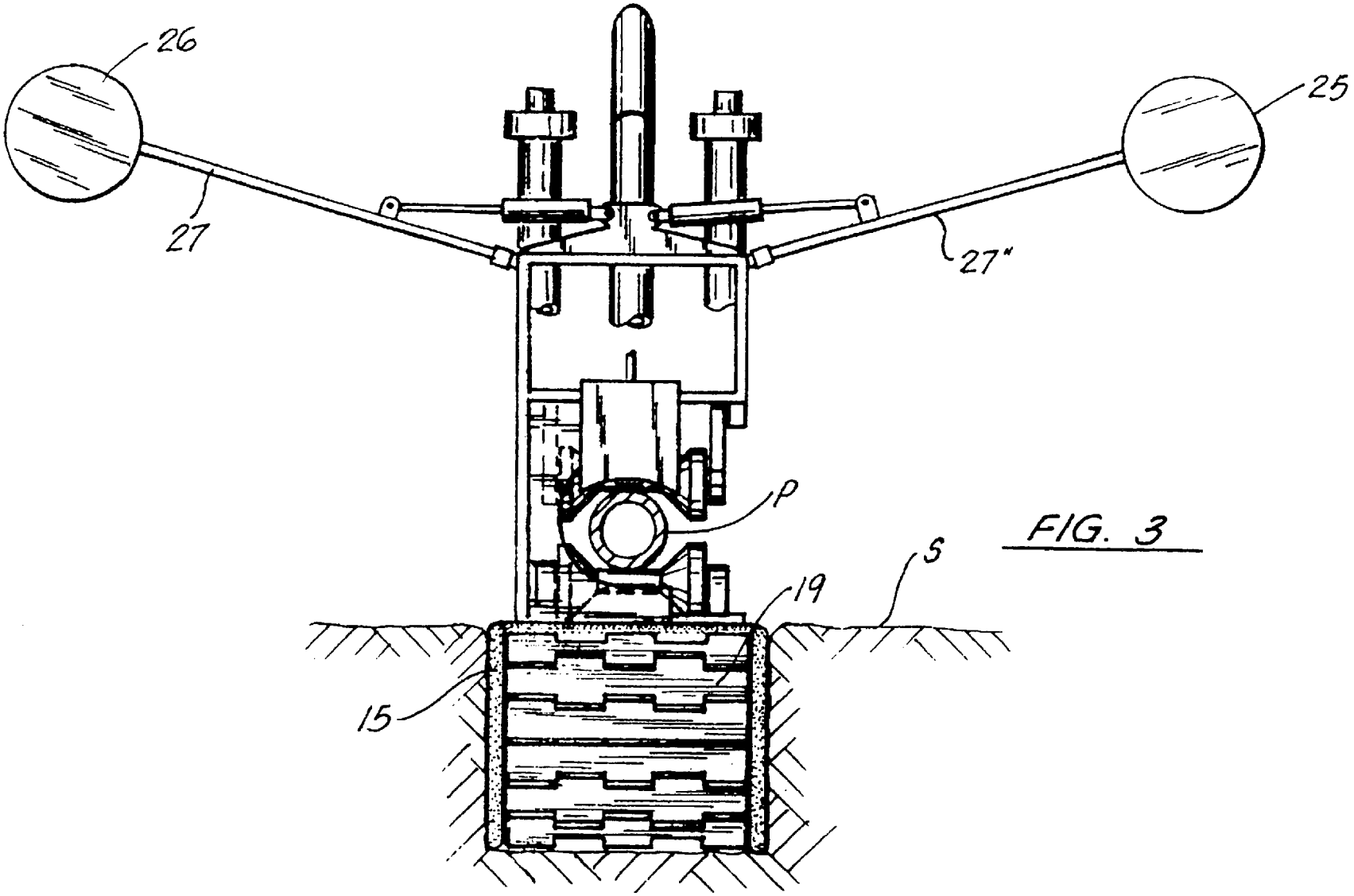
FIG. 3 is a frontal view of the underwater trenching apparatus of FIG. 1, illustrating the communication of the roller guide system with the pipeline, and positioning of the trench cutter mechanism and unit frame and ballast tanks.

FIG. 3 illustrates a front view of the present invention, illustrating the exemplary apparatus trenching a water bottom or seabed S. As shown, the cutter wheel 19 rotates in downwardly revolving, forward cutting and driving matter, with the spray array 15 configured to loosen and disperse trenched material, much of which is directed into the cutter wheel housing via the cutter wheel and suction therebehind.

As further shown in FIG. 3, the pontoons 26, 25 are at their upper position, held in place via pivot arms 27, 27", respectively, providing balanced buoyancy support to the system.

Figure 9:
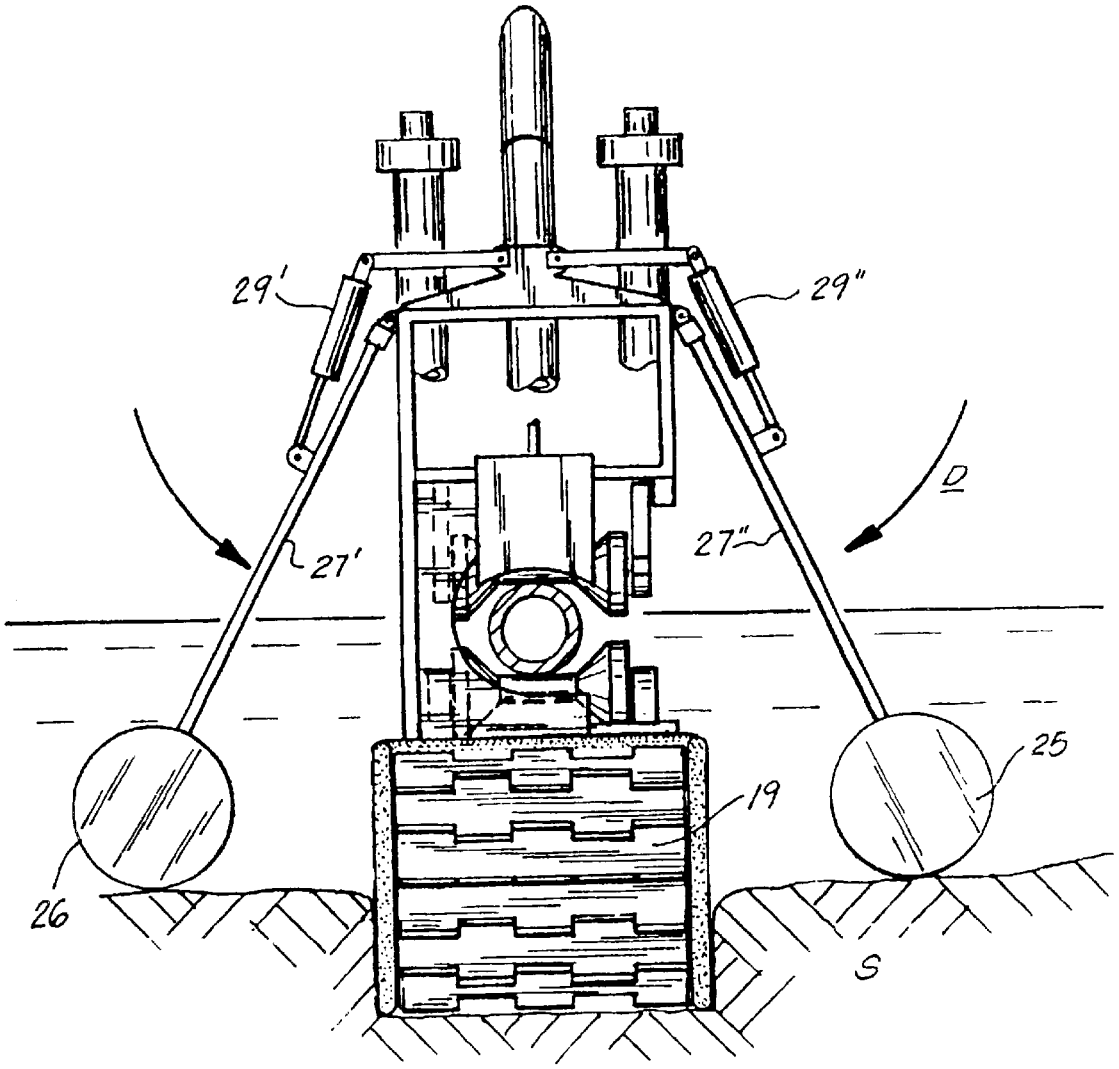
FIG. 9 lilustrates a frontal view of the underwater trenching apparatus of FIG. 1, illustrating the positioning of the ballast tanks for use as skids in shallow water.

FIG. 9 illustrates an alternative position of the pontoons 26, 25 in the present invention, to allow said pontoons to perform as skids along the seabed S in shallow water where there is insufficient water depth to provide the desired buoyancy, or where a trench shallower than the height of said cutter wheel is desired. As shown, the reciprocating pistons 29', 29" have been extended to drive the pivot arms 27', 27" downward D, until said pontoons 26, 25, communicate with the seabottom S, supporting the unit frame and cutter wheel.

POWER SOURCE #1

The main power source of the present invention comes from the compulsion force of the three eight inch hydraulic driven pumps. Two of the pumps (21, 22) are mounted on the rear of the machine and the other one is on the Ditch Digger (35) and discharging from the rear of the machine, powering the machine forward.

The two pumps on the rear of the machine serve three purposes:

1. They pump the mud out of the ditch which the pipe will be buried in;
2. The compulsion force drives the machine forward; and
3. By regulating the speed of each pump individually, one can control the direction in which the machine travels.

POWER SOURCE #2

The Ditch Digger or cutter wheel (19) is powered by a hydraulic motor and gear reduction drive, which will serve two purposes:

1. The teeth of the Ditch Digger are arranged in such a manner as to cut the bottom (being mud) into small pieces
2. The eight inch pump (35) mounted on the rear of the cutter wheel will discharge the mud to the rear of the machine while forcing the machine forward. The teeth are grabbing and cutting the bottom causing this forward movement of the machine.

POWER SOURCE #3

The pipe is held on place by four rollers which may be the traditional hourglass shape, or may be somewhat grooved to fit the contour of the pipe. The two bottom rollers (10A,B) are mounted in a stationary position. The two top rollers (11A,B)are in a frame pivoted on one end controlled on the other each by hydraulic screw jacks (31, 32). Each screw jack applies force to the frame of the roller, in turn, the rollers hold the pipe in place in the frame of the machine. The rollers are also used as a power source to drive the machine forward or backward. They are powered by a hydraulic motor(50,51) on each roller.

When the machine comes to an obstacle on the pipeline, an air-over hydraulic or electric switch will cause the top, rear and front rollers to come off the pipeline until the obstacle passes through the machine, then an air-over hydraulic or electric switch mounted on the rear of the machine will reverse the direction at the hydraulic screw jacks to apply pressure once again on the pipeline. The screw jacks can be electro-mechanical or hydro-mechanical, as desired.

When the rollers are in the raised position, the machine is powered forward by compulsion force of the three eight inch hydraulic powered pumps and the Ditch Digger located in front of the machine, continuously digging the bottom and pulling the machine forward.

PONTOONS

The Underwater Ditch Digger has two pontoons (25, 26), one mounted on each side of the machine. They are adjustable to allow the machine to bury pipe in water depths from three feet.

The pontoons hold the machine in a vertical position when burying pipe. There are high pressure volume tanks built inside each pontoon to store air so that the water can be blown out of the bottom of each pontoon when the machine needs to be made lighter. A valve on top can be opened to let the air out and water in, to give it to more weight.

There are two hydraulic cylinders per pontoon. The cylinders are closed and the pontoons are in a vertical position for deep water. For shallow water the pontoons are in a ninety degree position, with the machine and the cylinders extended out.

The Ditch Digger cuts a ditch at a minimum of thirty inches deep, the height of the cutter wheel and spray array, in one pass. It pulls the machine forward as it is cutting the ditch. It has a jetting pipe or spray array (15) mounted around the housing of the cutter with nozzles. Two hydraulic cylinders (34) push the Ditch Digger down for a deeper ditch. It has an eight inch pump (35) mounted on the back end of the cutter housing (12) to pump the mud out and is also used for compulsion force to help move the machine forward. The blades are made of a material similar to the road grader blades material. The cutting blades are mounted inside a funnel to catch the mud. In doing this the eight inch suction pump will be able to pump it out to the rear of the machine.

JET PUMP

There is a high pressure water pump, or series of two pumps as shown in FIG. 8 driven by hydraulic motor, mounted on the machine, supplying high pressure water to the jet nozzles, which are mounted on a pipe around the Ditch Digger. This high pressure water helps soften the bottom and therefore makes it easier for the Ditch Digger to chop up mud, debris, etc.

FRAME

Figure 10:
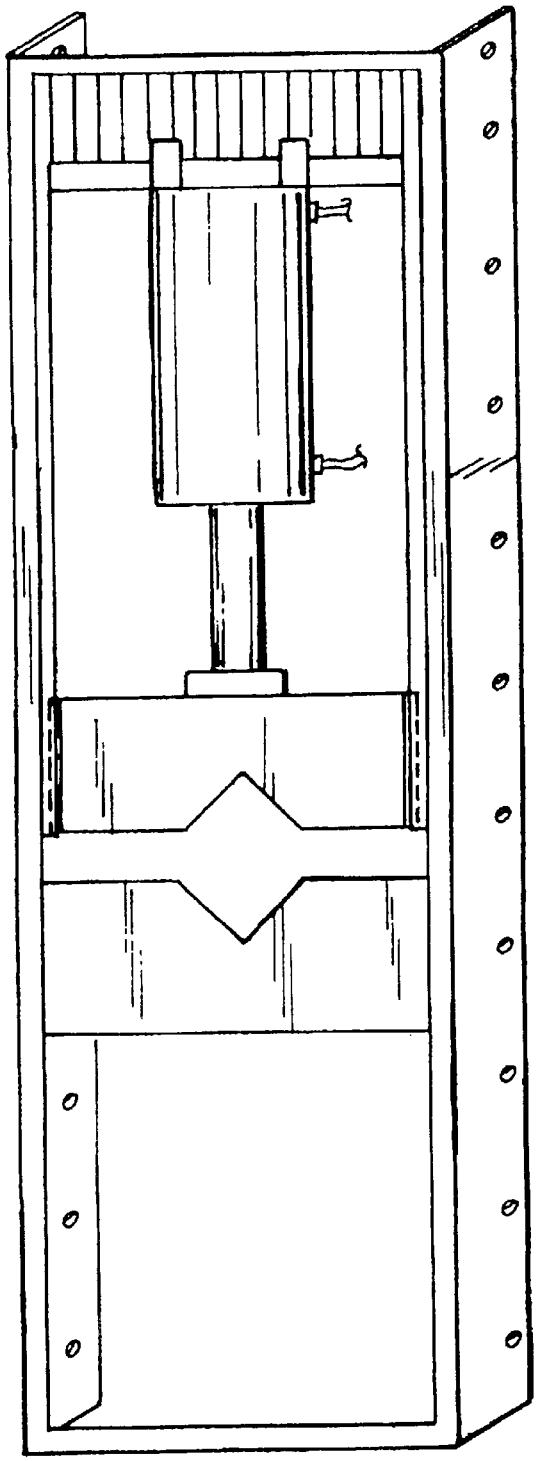
FIG. 10 is an isometric view of a removable shear module to be placed at the rear of the unit frame of the present invention when performing the alternate task of removin and cutting pipe from a buried pipeline.

The unit frame (2) may be made out of square tubing and is designed so the pipe is placed in the machine from the side. It is designed to withstand the pressures put on it by the forward thrust of the pumps, the screw jacks applying pressure downward on the top rollers, the pontoons upward lifting and also the forward pulling of the Ditch Digger. It is designed to hold three mud pumps, a jet pump and the pontoons. The pipe burying equipment is removable so the frame can be used as a pipe retriever and by adding a hydraulic shear (FIG. 10) on the rear of the machine also cut up the salvage pipe into desired length. By removing the shear it can be used as a devise to lay pipelines.

HOSE REEL

A hose reel may be utilized in the present system, said reel designed to accommodate the bundle of hydraulic hoses going from the hose reel to the Ditch Digger allowing for three hundred to six hundred feet of extra hose. The shaft is drilled and grooved in such a manner that each pressure and return hose has its own port. The drum rotates on the shaft, which is stationary, the drum is powered by a hydraulic motor and chain drive with sprockets. The stand that the hose reel is housed is mounted on a barge or boat and enables an operation to let out or take up the hose as desired without disconnecting the hoses from the reel.

HYDRAULIC HOSES

The hydraulic hoses or power lines are strapped together in a bundle. There are approximately twenty hoses going to the machine. The pressure hoses are three thousand PSI hoses, and a two hundred fifty PSI air hose. The hoses have hydraulic quick disconnect on either end and are made up from three hundred to six hundred feet in length, the hoses are fastened to the hose reel on one end and the Ditch Digger machine on the other end.

CONTROL PANEL

The control panel is located upon a surface vessel, and has gauges and flow meters so an operator can monitor the machine at all times. There are directional valves to operate the machine, which one controls how fast the machine moves on the pipeline, how fast the Ditch Digger is turning, the amount of jet pressure, the mud pumps, the cylinder on the Ditch Digger to determine the depth of the ditch, the pontoons and the screw jacks, etc. The control panel may be connected to the hose reel with hydraulic disconnects on one end and the other to the power unit. The control panel is mounted on the deck of a barge of boat.

ANODE JUMPER

The anode jumper may consist of two toggle switches mounted on the machine, one on the front and one on the rear. The toggle switches are hooked to an air-over hydraulic or electrical directional valve that controls the direction. The hydraulic or electrical screw jack turns, either raising or lowering the rollers on the pipe. When the machine comes in contact with an anode, the screwjack will raise the rollers and let the anode pass through the machine, then lower the rollers back into position on the pipe, as this process is taking place, the mud pumps and the Ditch Digger propel the machine forward. By using this method, one set of rollers are not trying to power the machine forward by itself, which could spin on the slick pipe and damage the coating on the pipeline.

SCREW JACKS

The powered screw jacks are mounted in a vertical position over the frame in which the rollers are housed in. The frame is hinged on one end with pillow-block bearings, the rollers being on the opposite end. The screw jack powers the rollers up and down on the pipe with a pre-set amount of pressure. This pressure on the rollers hold the pipe in place in the frame and also keep the rollers from spinning on the pipe while the rollers are being used to force the machine forward. The screw jacks are controlled by the anode jumper switches and also by the operator on the barge when the pipeline is being placed in the machine.

An advantage of using screw jacks is that they will not loosen up on the pipeline (verses the hydraulic cylinder) until they are powered by hydraulic pressure, either from the anode jumper on the machine or the operator on the barge.

POWER UNIT

The power unit may consist of a diesel engine driving four or more hydraulic pumps. The diesel engine is compatible to a twelve cylinder Detroit engine. The pumps are mounted in a series on the rear of the engine. There is a volume tank for the hydraulic oil, a manifold to distribute the oil to the desired working positions, pressure setting and relief valves to set the desired pressure for each working component of the machine. The unit is built on-skid and is mounted on a barge or boat and supplies power through the control panel to the machine.

PONTOON CYLINDERS

There are two pontoons (25, 26), one on either side of the machine, each having two hydraulic cylinders. The hydraulic cylinders are attached from the frame of the machine to two arms extended to the pontoons. The arms will rotate the pontoons from ninety degrees of the machine to one hundred eighty degrees of the machine. Tthe hydraulic cylinders work independently in pairs, two for each pontoon, therefore one pontoon can be ninety degrees of the machine and the other one hundred eighty degrees with the machine. This enables the machine to stay in a vertical position when there is a cross current, when the pontoons are both extended to ninety degrees with the machine, it enables pipe to be buried in water as shallow as three feet.

SUCTION PIPES OR LATERAL COLUMN MUD LIFTS

There are two suction pipes or lateral column (17, 20) mud lifts on the rear of the machine, in a vertical position, extending from the bottom of the frame to above the frame, the frame being made into three sections: top, middle, and bottom. One of the suction pipes is made in three sections. A section mounted to the bottom and top sections of the frame, the center section of the suction pipe is grooved on each end for two "O" rings. The center section fits inside the top section and is powered downward to fit inside the bottom section of the suction pipe, forming a sealed fit on both ends of the center suction pipe. This forms a continuous length of pipe.

The hydraulic driven mud pumps are mounted on top of the suction pipes, with a discharge pipe (which is smaller) pointed to the rear and outward of the machine. This giving the machine a compulsion force forward and discharges the mud and debris out of the ditch. The two discharge pipes (54)are ninety degrees to the suction pipes. The third discharge pipe (24) comes from the rear of the Ditch Digger to the top rear of the machine and discharges the mud and debris to the rear and outward of the machine also causing a compulsion to push the machine forward.

DITCH DIGGER OR CUTTER WHEEL (19)

The Ditch Digger is the apparatus used on the machine to cut a ditch in the bottom of a body of water so that a pipeline can be buried or cable, etc. it is powered by a hydraulic motor and gear reduction drive by chain or shaft. The Ditch Digger blades are housed in a funnel opened on the forward end and an eight inch suction pump on the other. The pump serves two purposes: (1) To suck the mud and debris that the blades cut and extract them to the rear of the machine which causes also a compulsion force to help power the machine forward, (2) The blades have shaft through the center, a sprocket is positioned in the middle of the shaft, which is connected to the gear drive. The blades are made in two sections allowing a gap of approximately two inches between them for the driving chain or shaft. The chain has a coin guard built around it with seals in the shaft to keep the mud off the chain and sprockets. The blades are attached to the funnel by self sealed flange bearing, also there are two hydraulic cylinders attached to the funnel from the frame to dig a deeper ditch. The cylinders are extended and the funnel rotates on a shaft on the bottom rear of the funnel and is exerted downward to the required depth of the ditch being dug.

METHOD OF RETRIEVING AND LAYING PIPE

Remove the Ditch Digging equipment from the machine and mount the hydraulic shear (FIG. 11) on the rear of the machine. The four rollers grooved to the pipe size, guides and pulls the pipe off the bottom onto the barge or boat. It travels through the machine and the shear cuts the pipe to the desired length. The cut-off pieces fall into a rack mounted over a pan. The pan catches any oil spilled. When the desired amount is cut, it is banded up and ready for shipment to be disposed of.

This method eliminates spilled oil or gas out of the pipelines into the water and also fire from cutting the pipes with a torch.

By removing the dredging equipment and the hydraulic shear the machine becomes a tension device for laying pipelines.

Two machines can be used at one time. One used as a tension shoe, the other used to bury the pipe as it is being laid. Now two jobs can be done in the time it used to take to do one. Also, the job of retrieving and salvaging old abandoned pipelines is cleaner and safer, using the Ditch Digger, for the environment and for the men working on the project.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

ALTERNATIVE EMBODIMENTS OF THE INVENTION

Figure 11:
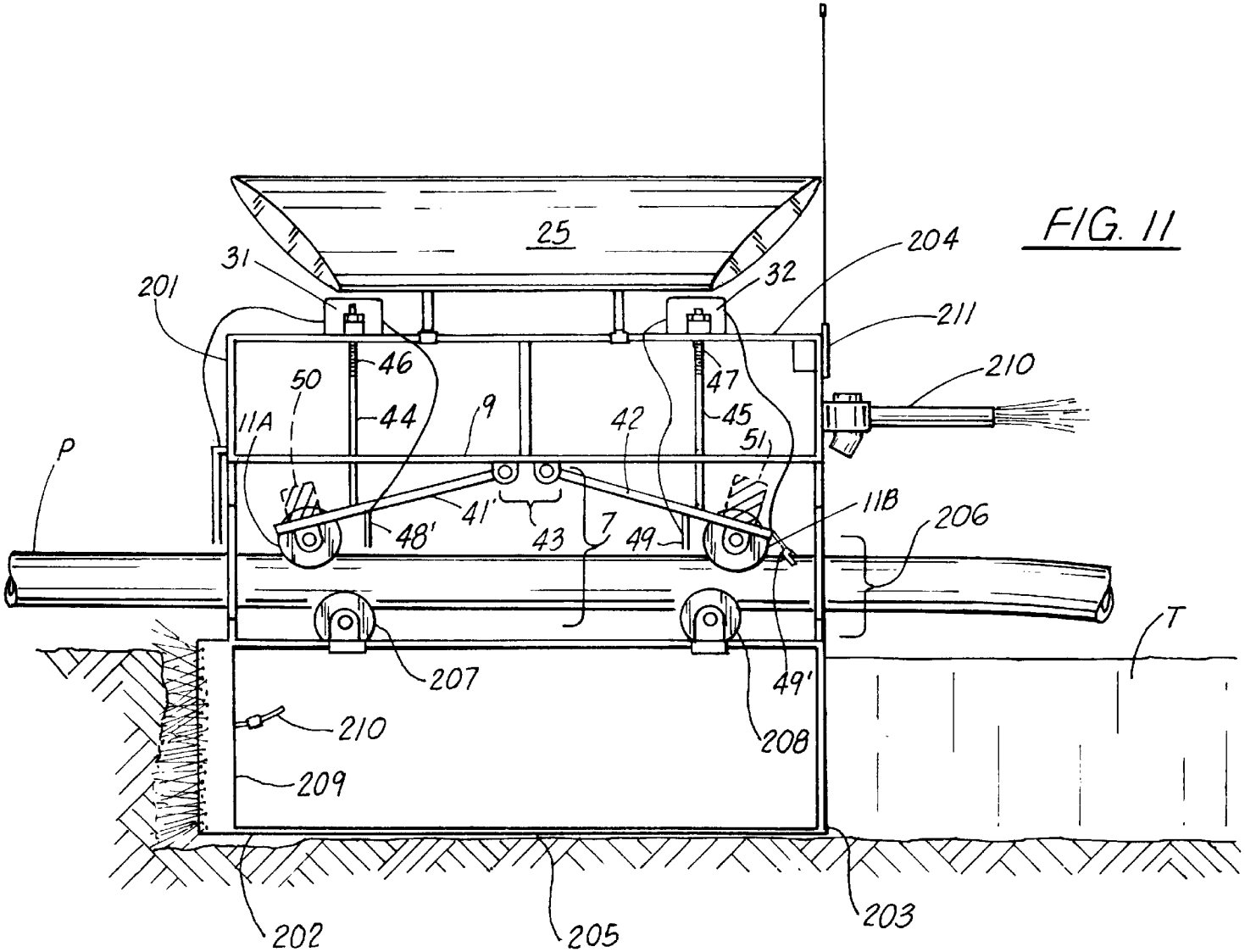
FIG. 11 is a side view of an alternative embodiment of the present invention, illustrating a frame having high pressure jets provided at the forward end of the frame, a rear thruster for propulsion, G.P.S. position determination, and hinged lower rollers for bottom installation of the pipe through the frame.
Figure 12:
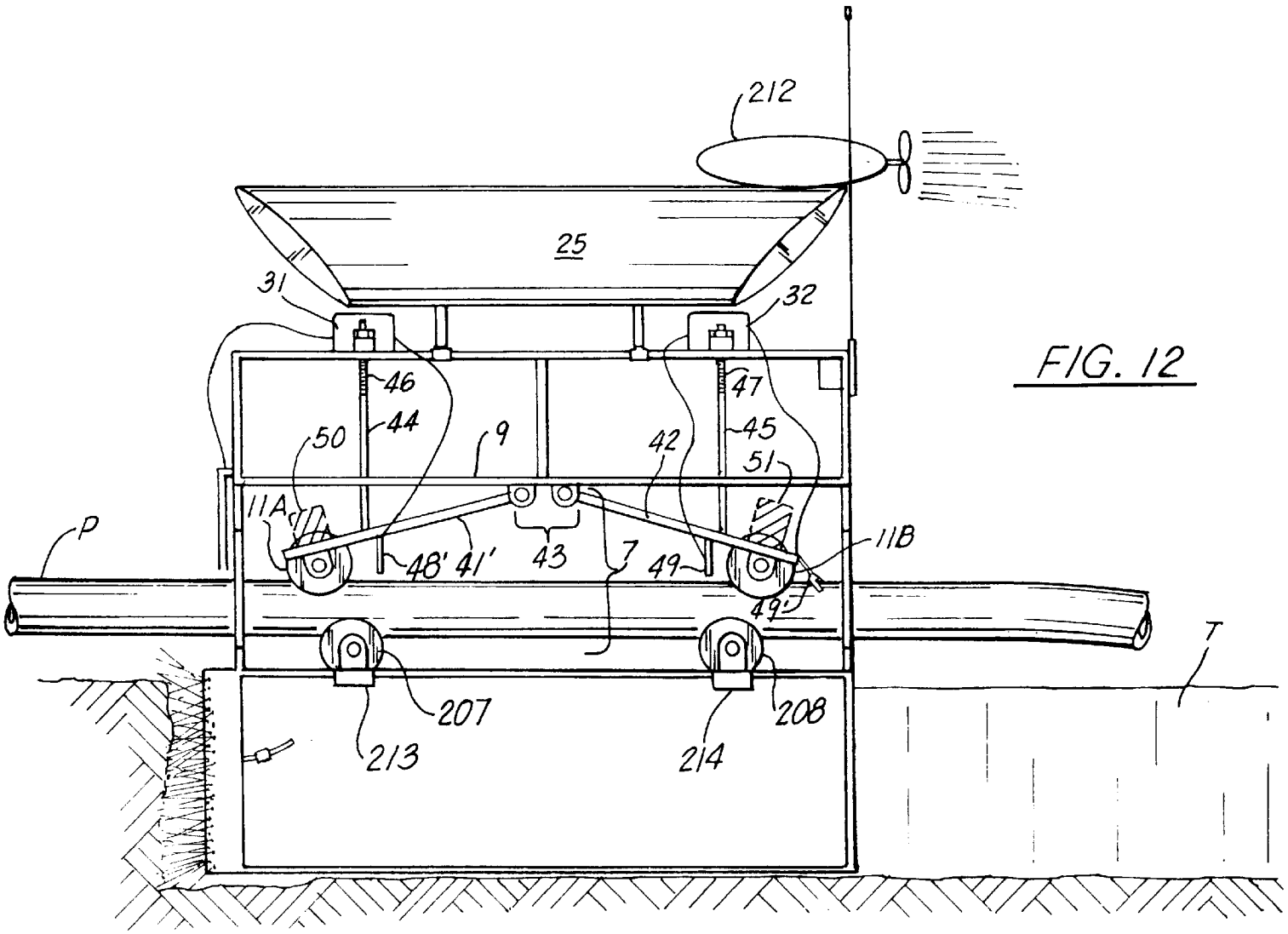
FIG. 12 illustrates the alternative embodiment of FIG. 11, but with the implementation of propeller-driven pontoons as opposed to rear thrusters.
Figure 13:
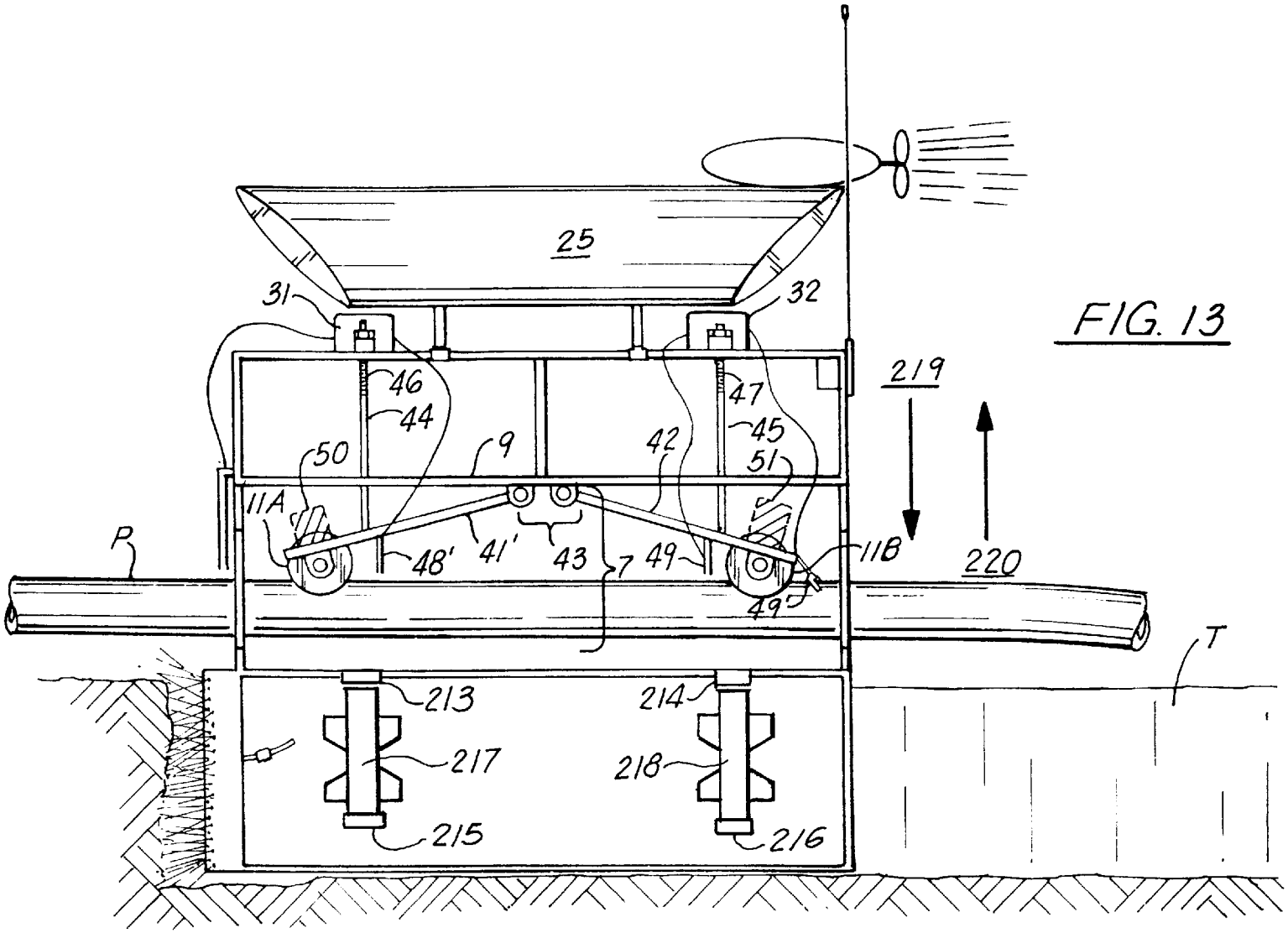
FIG. 13 illustrates the opening of the lower portion of the frame for the pipe, showing the lower rollers in their vertical position for passage of the pipe therethrough.

Referring to FIGS. 11–13, an alternative embodiment of the present invention, especially configured for utilization on water bottoms including sugar sand, light mud suspensions or the like, is also provided, contemplating a frame 201 having front 202 and rear 203 ends, a top 204 and a bottom 205, and a pipe passage 206 formed therethrough enveloped by upper and lower 207, 208 rollers. The frontal portion of the frame includes a forwardly emanating high pressure jet array 209 powered by a high pressure pump via hose 210, projecting water for trenching the water bottom, while the rear portion may include rearwardly emanating thrusters 210. The bottom of the frame is open, having no cross-members situated under the lower roller area, to allow the passage of pipe longitudinally through the frame via the bottom of the frame.

Other options for the present invention include a G.P.S. (global positioning satellite) navigational system 211 provided on the frame of the unit, configured to relay the position of the unit to the operating barge or other vessel via wire, sonar, or RF transmission or the like.

Referring to FIG. 12, alternatively, driven impellers or propellers 212 may be provided affixed to first 25 and second pontoon members, to provide controlled, steerable forward or rear propulsion of the system. The thrusters, impellers, or propellers may be provided in pairs at opposing sides of the vessel, or in the case of pontoons, one on eaci pontoon, so as to allow one to maneuver, or steer the unit, when desired, via selective? powering of each of the thrusters, impellers, or propellers. Thusly, the unit may be able to be controlled to some degree without communication with the pipe, such as in situations at the beginning or end of a pipeline, or installation or de-installation of the unit to commence or complete trenching operations.

As shown, the lower rollers have first and second ends which are supported by a roller frame having first and second ends, forming first and second roller support members, respectively. Each of the roller support members are hingedly attached to the frame at one end 213, 214, and releasably attached at the opposing end, via releasable bracket or the like, as shown in FIG. 13.

Continuing with FIG. 13, the roller support members 217, 218 are shown in a generally vertical, open position, so as to allow the passage of pipe P therethrough, the roller support member each having first and second ends, the first end hingedly connected 213, 214 to a side of the frame at one end, and supported by said hinged end when the opposing end is detached. Once opened, the frame may then be lowered 219, effecting installation of the frame about the frame, or raised 220, removing the frame from the pipe.

The hinged movement of the roller support members may be provided manually, via SCUBA divers or the like, or pneumatically, via motors or the like, as will be more fully discussed. Upon the positioning of the first and second roller support members in their generally horizontal, support, closed positions, the brackets at their respective second ends engage the frame at the opposing side of the first end, and the rollers thereby generally envelope the lower portion of the pipe P.

Figure 14:
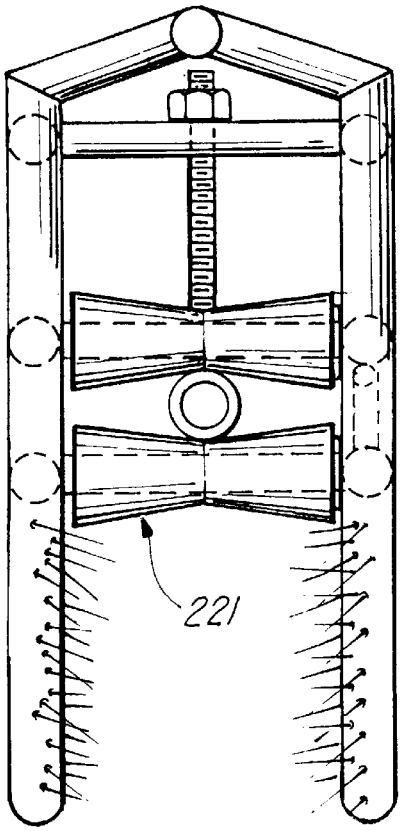
FIG. 14 and 14' illustrate an alternative embodiment of the invention of FIG. 11, illustrating powered lower rollers in closed and open positions, respectively.
Figure 14:
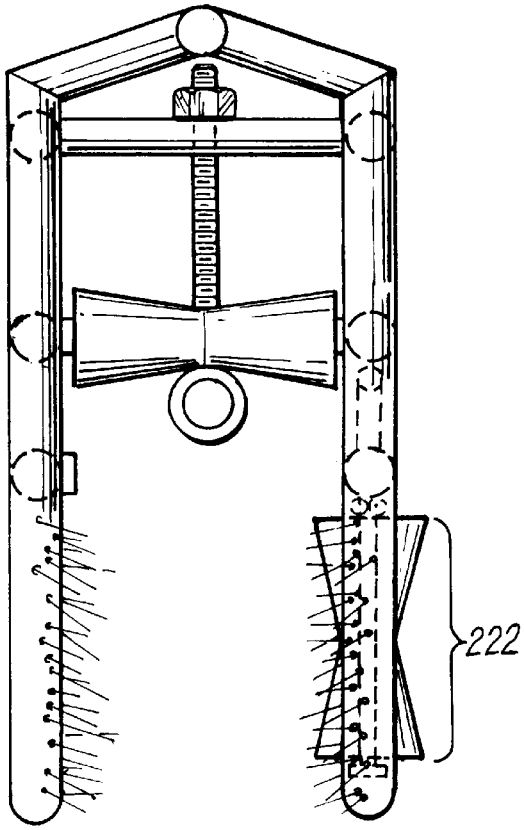

FIGS. 14, 14' illustrate a powered positioning system for positioning the roller support members in their generally closed, horizontal position 221 for closed rollers about the pipe, or the open, generally vertical position 222, providing an open passage for removal of the pipe, wherein the lower rollers are releasable at one end, and hingedly connected to the frame at the other end, end like the above embodiment of FIGS. 11–13, and further powered via hydraulic or other motor means from a pipe engaging, horizontal position to an open, generally vertical position, allowing passage of the pipe through the frame and up to or away from the upper rollers, for installation or de-installation of the frame about the pipeline, respectively.

Figure 15:
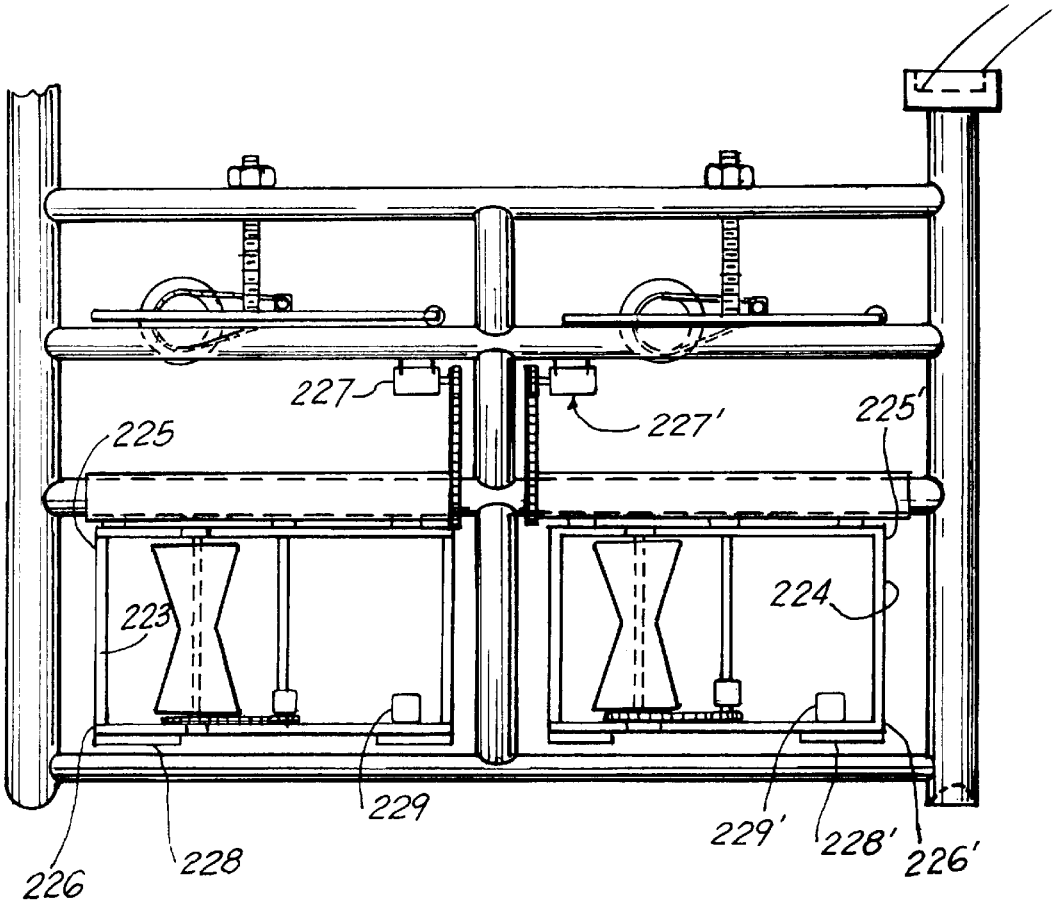
FIG. 15 illustrates a side view of FIG. 14', providing a view of the power rollers in their open position.

Referring to FIG. 15, the alternative embodiment of FIGS. 14, 14' contemplate first and second roller support members 223, 224, respectively having first 225, 225' and second 226, 226' ends, the first 225, 225' ends hingedly attached to one side of the frame, the second ends 226, 226' releasably attached to the opposing side of the frame, via brackets 228, 228' or the like. Motors 227, 227' communicate with roller support members 223, 224 to effectuate remote pivoting of the roller support members about their respective hinged ends, while actuators 229, 229' may be provided to latch and unlatch brackets 228, 228' in place.

What is claimed is:

1. An underwater trenching system for forming a trench in a seabed under water, and installing a pipeline into said trench, comprising:

a unit frame. said frame having upper and lower ends with a medial area therebetween, first and second sides, and a front and rear end, said medial area of said frame having formed longitudinally therethrough a pipeline passage, said pipeline passage also formed through said front and rear ends, said medial area further comprising upper and lower rollers configured to engage and roll along the pipeline to be installed, said lower rollers supported by roller support members having first and second ends, said first end of each of said roller support members hingedly affixed to one side of said frame, said second end of each of said roller support members releasably affixed to said other side of said frame, so as to provide said roller support members with open, generally vertically aligned positions, and closed, generally horizontally aligned positions, to allow the passage of pipe through the lower end of the frame in said open position, and to allow said lower rollers to generally envelope a portion of the pipe in said closed position;

a high pressure jet array situated generally at said front end of said unit frame, comprising a plurality of jet orifices forwardly emanating from the frame so as to provide a stream of high pressure water streams configured to engage and disperse the seabed, so as to form a trench;

propulsion means associated with said frame, said propulsion means configured to provide thrust directed rearwardly of said frame, in order to propel said frame in a frontal direction;

buoyancy/skid means for alternately providing buoyancy or skids for said unit frame, said buoyancy/skid means further comprising first and second pivot arms each having first and second ends, said first ends pivotally affixed to said frame, said first and second pivot arms extending in opposing directions generally away from said unit frame, said second end of said first pivot arm attached to a first buoyancy chamber, said second end of said pivot arm attached to a second buoyancy chamber, said first and second buoyancy chambers generally axially aligned with the longitudinal axis of said unit frame, said first and second pivot arms being adjustable to position said first and second buoyancy chambers, respectively, to a generally upper position relative said pipeline, away from said seabed, providing buoyancy to the unit frame, said first and second pivot arms being adjustable to position said first and second buoyancy chambers, respectively, to a generally lower position wherein said pontoons are lowered to contact said seabed, providing skids for supporting said unit frame on or over said seabed.

2. The underwater trenching system of claim 1, wherein said invention further includes navigational means for providing a navigational fix of the location of said system to a remote location.

3. The underwater trenching system of claim 2, wherein said navigational means comprises a G.P.S. (global positioning satellite) system.

4. The underwater trenching system of claim 1, wherein said propulsion means comprises rearwardly directed thrusters affixed to said frame.

5. The underwater trenching system of claim 1, wherein said propulsion means comprises propeller driven, first and second pontoons affixed to opposing sides of said frame.

* * * * *